United States Patent [19]

Rajewski

[11] 4,308,702

[45] Jan. 5, 1982

[54] PLASTIC BUILDING PANEL AND METHOD FOR MAKING SAME

[75] Inventor: Joseph J. Rajewski, Staten Island, N.Y.

[73] Assignee: GAF Corporation, New York, N.Y.

[21] Appl. No.: 174,044

[22] Filed: Jul. 31, 1980

Related U.S. Application Data

[63] Continuation of Ser. No. 754,988, Dec. 28, 1976, abandoned.

[51] Int. Cl.[3] ..... E04C 2/38; E04C 2/30; B32B 1/04

[52] U.S. Cl. ..... 52/519; 428/53; 428/122; 428/124; 428/174; 428/192; 428/213

[58] Field of Search ..... 428/80, 122, 124, 174, 428/192, 53, 213; 52/518, 519, 531, 550, 555, 560, 579; 264/280, 319

[56] References Cited

U.S. PATENT DOCUMENTS 1,583,969 5/1926 Greenstreet ..... 52/531
3,780,483 12/1973 Mattes ..... 52/550

*Primary Examiner*—Paul J. Thibodeau
*Attorney, Agent, or Firm*—James Magee, Jr.; Joshua J. Ward

[57] ABSTRACT

A plastic building panel having a thermoformed face and a thickened upper edge. The upper edge has a flange forming a downwardly facing U shaped opening. A flange at the bottom edge of the panel forms an upwardly facing U shaped opening. The panel is formed by first thermoforming a sheet of plastic and then heating along longitudinal fold lines near the edges of the panel and folding the edges along the fold lines to at least partially form the finished panel.

4 Claims, 7 Drawing Figures

2
50
34
18
26
14
30
36
24
20
28
48
2

PROFILE OF MOLD AND PART FORMATION

PLASTIC BUILDING PANEL AND METHOD FOR MAKING SAME

This is a continuation of application Ser. No. 754,988, filed Dec. 28, 1976, now abandoned.

BACKGROUND OF THE INVENTION

In the production of rigid plastic building panels such as siding and roofing panels it is frequently desirable to reproduce on the face of the panel the texture of wooden shake shingles or siding or other desired configurations. A commonly used technique for producing such panels is known as thermoforming. In a conventional thermoforming process a flat sheet stock is extruded and is then processed in either web form or as individual pieces. In the thermoforming process the plastic sheet stock is heated to a pliable state in a clamping frame and placed in contact with any of several types of molding apparatus. The molding apparatus imparts the desired configuration to the central areas of the sheet, after which the excess material is trimmed from the edges. Unfortunately, thermoforming places very definite limits on the configurations which may be used to provide for instance interlocking edge portions, nailing flanges, etc. on the panels. Typical molded rigid plastic material produced by thermoforming is described for instance in U.S. Pat. No. 3,593,479 to Hinds, the disclosure of which is incorporated herein by reference. Material produced in accordance with the teachings of the Hinds patent can have the desired texture on the face of the thermoformed portion; however, even utilizing the Hinds invention, the possibilities for forming various shapes of interlocked portions are considerably limited. Further, the interlocks which can be produced by thermoforming are generally not considered satisfactory because the amount of mold undercutting which can be used to form an interlock via thermoforming is limited by considerations of extracting the finished part from the mold and excessive thinning of material in the interlock area when a relatively small surface area of plastic must be conformed to a relatively large surface area of mold. It is therefore, an object of the invention to provide an improved plastic building panel having a thermoformed face but not subject to the disadvantages mentioned above.

SUMMARY OF THE INVENTION

In accordance with the present invention an elongated, rigid, one piece plastic building panel is provided. The panel has first and second longitudinally extending edge portions and first and second surfaces. The first edge portion has a first flange having a thickness about the same as that of the face of the panel extending outwardly from the first surface thereof to form a generally U shaped opening in a direction facing the second edge portion of the panel. The panel includes a thermoformed face portion extending from the first edge portion of the panel to the second edge portion thereof. The first edge portion also includes a thickened section extending from the first flange to the adjacent longitudinal edge of the panel with the thickened section having a thickness in cross section substantially greater than the thickness of the thermoformed face of the panel. The second edge portion of the panel has a second flange extending outwardly from the second surface of the panel and forming a generally U shaped opening in a direction facing the first edge portion of the panel.

The invention also includes a novel method for making panels of the type described above and a siding assembly utilizing such panels. The method comprises thermoforming a sheet of plastic of substantially uniform thickness to produce a panel having a thermoformed face and longitudinal flanges, selectively linearly heating such flanges along longitudinal fold lines thereof and then folding the flanges along the fold lines to at least partially form first and second longitudinal edge portions of the type described above. In a preferred embodiment, the flanges are each folded 180° and one of the thus folded flanges abuts and is secured to an unfolded portion of the panel to form one of the longitudinal edge portions of the panel with the fold line of such flange forming a longitudinal edge of the panel.

The siding assembly of the invention is a lapped siding assembly comprising a plurality of lapped siding panels of the invention on a generally vertical substrate.

FIGS. *3a–e* illustrate a suitable method of manufacturing product of the invention by the process of the invention.

DETAILED DESCRIPTION OF THE INVENTION

As mentioned above, the present invention provides an improved building panel, an improved lapped siding assembly utilizing the panel of the invention and an improved method for making such panels. While panels of the invention can be constructed from any suitable plastic, the invention is particularly applicable to rigid plastic building panels manufactured from conventional thermoplastic materials such as polyolefins (eg polyethylene), polycarbonates, polyvinylchloride (PVC), polyvinyl flourides, acrylic resins, acrylonitrile, butadiene, styrene, copolymers of acrylonitrile, butadiene and styrene (ABS) etc. PVC is a preferred plastic for use in the invention. Conventional filler material such as calcium carbonate, talc, asbestos, glass fibers, silicates, wood flour, etc. may be used along with other conventional additives, pigments etc.

Figure 1:
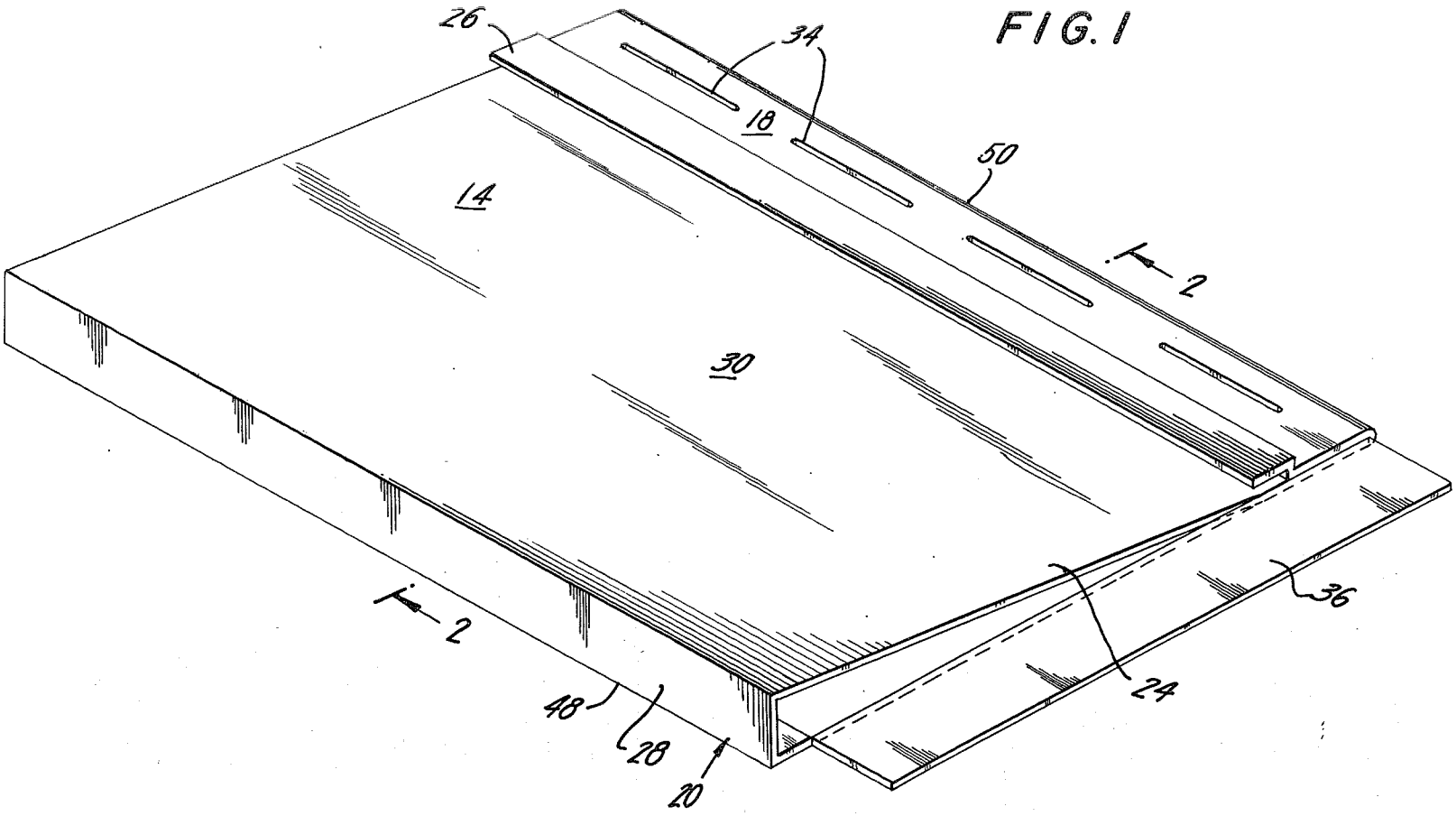
FIG. 1 is an isometric view showing a typical building panel of the invention.
Figure 2:
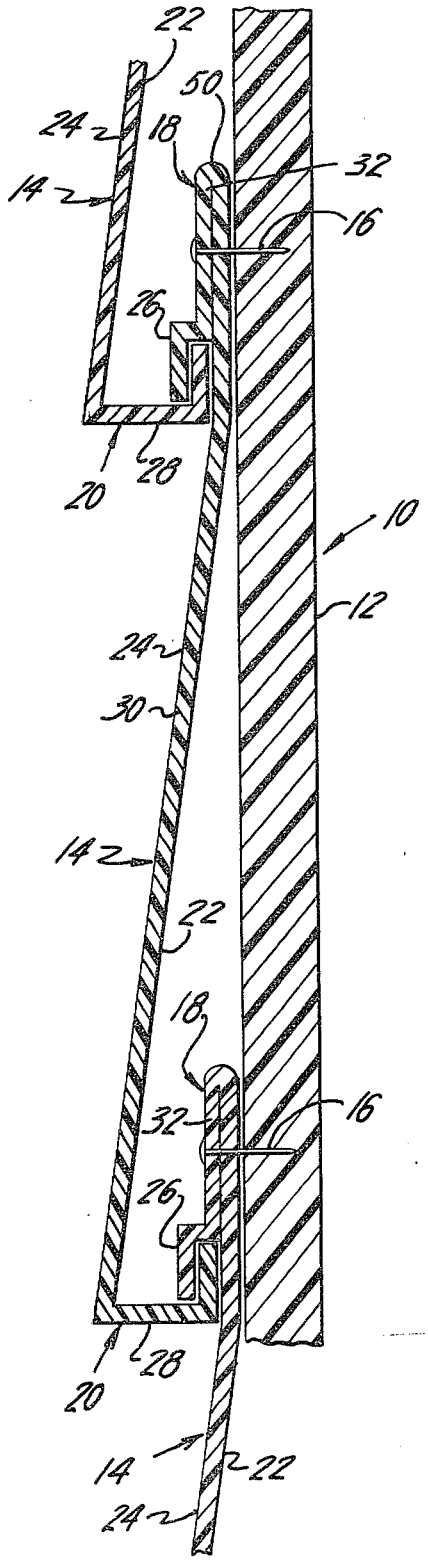
FIG. 2 is a sectional view of a siding assembly of the invention in which individual panels are shown in section as indicated by line 2—2 of FIG. 1.
Figures 3A, 3B:
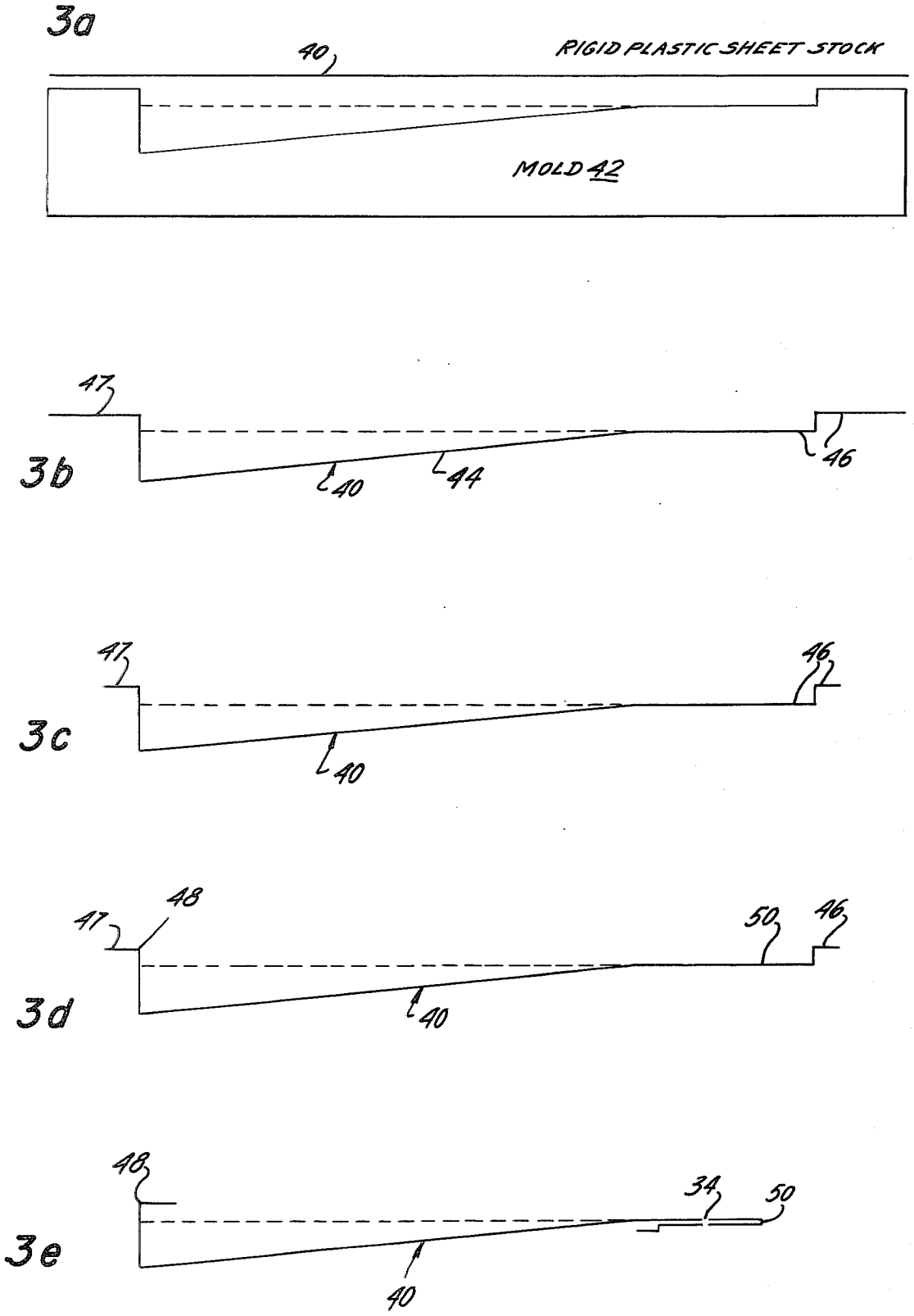

While the panels of the invention are preferably produced by the method of the invention, other suitable methods for producing such panels may be employed. For instance, panels of the invention may be produced by profile extrusion followed by thermoforming of the face of the extruded panels. For a more complete understanding of the invention, reference may be had to the drawings, especially to FIGS. 1 and 2 which show a lapped siding assembly 10 comprising a substrate 12 and a plurality of panels 14 constructed in accordance with the invention and fastened to the substrate by fastener means in the form of conventional nails 16. As indicated in FIGS. 1 and 2, each of the panels 14 has first and second longitudinally extending edge portions shown generally as upper and lower edge portions 18 and 20 respectively, and first and second surfaces shown as outer and inner surfaces 24 and 22 respectively. As shown, each upper edge portion 18 has a flange 26 which extends outwardly from the outer surface of the panel and forms a generally U shaped, downwardly directed opening. Likewise each of the lower edge portions 20 includes a flange 28 which extends outwardly from the inner surface of the panel and forms a generally U shaped opening in an upward direction. As is apparent from FIG. 2, individual panels are designed so that the flange of each lower edge portion engages the flange of the upper edge portion of the next lower panel in the assembly.

A thermoformed face portion 30 extends downwardly and outwardly from the upper edge portion of each panel to the lower edge portion thereof. As can be seen from FIG. 2, the upper edge portion 18 of each panel has a thickened section 32 which is of substantially greater thickness in cross section than the thickness of the face portion 30. The thickened section 32 preferably has a thickness at least about twice that of the face portion 30 and when the panels are made in accordance with the process of the invention will normally have a thickness about twice that of the face portion 30. As best seen in FIG. 1, each of the panels 14 may also include conventional slots 34 for the nails 16 to pass through and a conventional end lapping flange 36 for providing an overlap between adjacent sections of siding panels during installation so that rain penetrating between the abutting panels can not get through to the substrate. The end lapping flange may be formed in a conventional manner by trimming a portion of the upper and lower edge portions from an end of each length of panel.

For a better understanding of the method of the invention, reference may be had to FIGS. *3a–e* which illustrate the production of a panel of the invention by the method of the invention. FIG. *3a* depicts an extruded sheet 40 of a rigid plastic of substantially uniform thickness prior to thermoforming of a portion of the sheet in a conventional mold 42. FIG. *3b* depicts the sheet 40 after thermoforming to form a thermoformed face 44 and flange portions 46 and 47. FIG. *3c* depicts the same sheet after the flanges have been trimmed in a conventional manner. FIG. *3d* illustrates selective linear heating along longitudinal fold lines 48 and 50 of the flanges 46 and 47 to allow folding of the flanges in accordance with the invention. Selective linear heating along these fold lines may be accomplished by any suitable means such as by the application of a hot straight edge to the sheet of plastic along the line to be heated. Following heating to a temperature sufficient to soften the plastic and allow folding of the flanges (which temperature will, of course, vary widely depending upon the particular plastic used) the flanges are folded along the fold lines 48 and 50 to form the configuration illustrated in FIG. *3e*. It is apparent that this method can be used to produce the panels 14 described above, in which case the fold lines 48 and 50 will represent an upper longitudinal edge 50 of the panel 14 and a lower longitudinal edge 48 as depicted in FIG. 1. In a preferred embodiment, the method of the invention is carried out as illustrated in the drawings so that the flanges such as 46 and 47 are each folded 180° with one thus folded flange such as 46 abutting and secured to an unfolded portion of the panel to form one of the edge portions of the panel such as the upper edge portion 18 shown in FIGS. 1 and 2. Production of panels 14 in this manner provides suitable interlocking means for installation of the panel and especially provides the thickened portions 32 of the upper longitudinal edge portions which cannot be provided by conventional thermoforming processes. In a preferred embodiment of the invention, the folded over portions of the flanges such as 46 are secured to unfolded portions of the flanges by suitable means such as heat or sonic welding so that thickened portions 32 of the finished panels are not subject to separation along the fold lines during installation or use. While the general technique of thermoforming followed by folding of flanges along heated fold lines has been used in the past to form hollow outer edge portions of products such as plastic shutters, this technique has not previously been recognized as suitable for use in the manner described above in the production of building panels.

While the invention has been described above with respect to preferred embodiments thereof, it will be understood that various changes and modifications may be made without departing from the spirit and scope of the invention.

What I claim is:

1. An elongated rigid one piece plastic building panel having first and second longitudinally extending edge portions and first and second surfaces and further characterized by:

(a) said panel including a thermoformed face portion extending from the first edge portion of the panel to the second edge portion thereof;

(b) said first edge portion having a first flange extending outwardly from said first surface and forming a generally U shaped opening in a direction facing said second edge portion;

(c) said first edge portion including a thickened section extending from said first flange to the adjacent longitudinal edge of the panel, said thickened section comprising abutting layers of material of the panel and having a thickness in cross section at least about twice the thickness of the face of the panel;

(d) said first flange extending outwardly from said thickened section and extending in a direction from said thickened section towards said second edge portion; and (e) said second edge portion having a second flange extending outwardly from the second surface of the panel and forming a generally U shaped opening in a direction facing the first edge portion of the panel.

2. A panel according to claim 1 wherein the thickened section comprises abutting layers of material of the panel folded about 180° along a fold line which forms a longitudinal edge of the panel and wherein the portion of the first flange extending outwardly from the thickened section and in a direction from the thickened section towards the second edge portion has a thickness in cross section about the thickness of the face of the panel.

3. A lapped siding assembly comprising a plurality of lapped, elongated, horizontal, rigid one piece plastic building panels on a generally vertical substrate, each panel having generally horizontal and parallel upper and lower edge portions, each panel, having inner and outer surfaces and each panel being further characterized by:

(a) a thermoformed face portion extending from the upper edge portion of the panel downwardly and outwardly to the lower edge portion thereof;

(b) the upper edge portion having a first flange extending outwardly from the outer surface thereof and forming a generally U shaped downwardly facing opening;

(c) the upper edge portion including a thickened portion secured directly to said substrate and extending from the first flange to the adjacent longitudinal edge of the panel, said thickened portion comprising abutting layers of material of the panel and having a thickness in cross section at least about twice the thickness of the face of the panel;

(d) said first flange extending outwardly from said thickened section and extending in a direction from said thickened section towards said second edge portion, the portion of the first flange extending outwardly from the thickened section and in a direction from the thickened section towards the second edge portion having a thickness in cross section about the thickness of the face of the panel; and (e) the lower edge portion having a second flange extending outwardly from the inner surface of the panel and forming a generally U shaped upwardly facing opening.

4. A siding assembly according to claim 3 wherein the thickened section of the upper edge portion is at least about twice as thick in cross section as the face of the panel and wherein the thickened section of each panel comprises abutting layers of material of the panel folded about 180° along a fold line which forms a longitudinal edge of the panel.

* * * * *